US008109247B2

(12) United States Patent
Wakade et al.

(10) Patent No.: US 8,109,247 B2
(45) Date of Patent: Feb. 7, 2012

(54) WEAR RESISTANT CAMSHAFT AND FOLLOWER MATERIAL

(75) Inventors: Shekhar G. Wakade, Grand Blanc, MI (US); Simon Chin-Yu Tung, Rochester Hills, MI (US)

(73) Assignee: GM Global Technology Operations LLC

( * ) Notice: Subject to any disclaimer, the term of this patent is extended or adjusted under 35 U.S.C. 154(b) by 731 days.

(21) Appl. No.: 12/123,062

(22) Filed: May 19, 2008

(65) Prior Publication Data

US 2009/0283063 A1 Nov. 19, 2009

(51) Int. Cl.
*F01L 1/24* (2006.01)
*F01L 1/047* (2006.01)

(52) U.S. Cl. ..... 123/90.51; 123/90.6

(58) Field of Classification Search ..... 123/90.51, 123/90.6; 29/888.4, 888.43; 148/218
See application file for complete search history.

(56) References Cited

U.S. PATENT DOCUMENTS

| | | | | |
|---|---|---|---|---|
| 4,856,469 | A * | 8/1989 | Okazaki et al. | 123/90.51 |
| 4,873,150 | A * | 10/1989 | Doi et al. | 428/627 |
| 5,456,766 | A * | 10/1995 | Beswick et al. | 148/216 |
| 5,542,990 | A * | 8/1996 | Nakamura et al. | 148/319 |
| 7,112,248 | B2 * | 9/2006 | Yamaguchi | 148/218 |
| 7,246,586 | B2 * | 7/2007 | Hosenfeldt et al. | 123/90.51 |
| 7,490,583 | B2 * | 2/2009 | Suzuki et al. | 123/90.44 |
| 7,614,374 | B2 * | 11/2009 | Watanabe et al. | 123/90.39 |
| 2003/0097902 | A1 * | 5/2003 | Takiguchi et al. | 74/605 |
| 2005/0284434 | A1 * | 12/2005 | Tsuruta et al. | 123/90.51 |
| 2006/0027200 | A1 * | 2/2006 | Tsuruta et al. | 123/90.51 |
| 2006/0049035 | A1 * | 3/2006 | Hosenfeldt et al. | 204/192.15 |
| 2008/0163839 | A1 * | 7/2008 | Watanabe et al. | 123/90.41 |
| 2008/0276753 | A1 * | 11/2008 | Takamura | 74/567 |
| 2009/0276992 | A1 * | 11/2009 | Maeda et al. | 29/428 |

FOREIGN PATENT DOCUMENTS

| | | |
|---|---|---|
| CN | 1497194 A | 5/2004 |
| WO | 8300051 A1 | 1/1983 |

OTHER PUBLICATIONS

Eyre et al., Camshaft and Cam Follower Materials, Tribology Int. vol. 13, No. 4, pp. 147-152. Aug. 1980.*

T. S. Eyre and B. Crawley, "Camshaft and cam follower materials", Tribology International, vol. 13(4), 1980, pp. 147-152.*

* cited by examiner

*Primary Examiner* — Thomas Denion
*Assistant Examiner* — Daniel Bernstein
(74) *Attorney, Agent, or Firm* — Harness, Dickey & Pierce, P.L.C.

(57) ABSTRACT

A materials combination for a camshaft and follower of an engine valve train provides excellent wear resistance. The camshaft or camshaft lobes are made from a malleable cast iron and the cam followers are made from a carbonitrided 52100 or 4130 steel to provide excellent wear resistance equivalent to diamond-like coatings at greatly reduced cost.

8 Claims, 1 Drawing Sheet

WEAR RESISTANT CAMSHAFT AND FOLLOWER MATERIAL

FIELD

The present disclosure relates to valve trains and more particularly to wear resistant camshaft and follower designs.

BACKGROUND

The statements in this section merely provide background information related to the present disclosure and may not constitute prior art.

Engine designers and engineers are constantly challenged to innovate products in order to meet ever demanding emissions and fuel economy targets.

Figure 1:
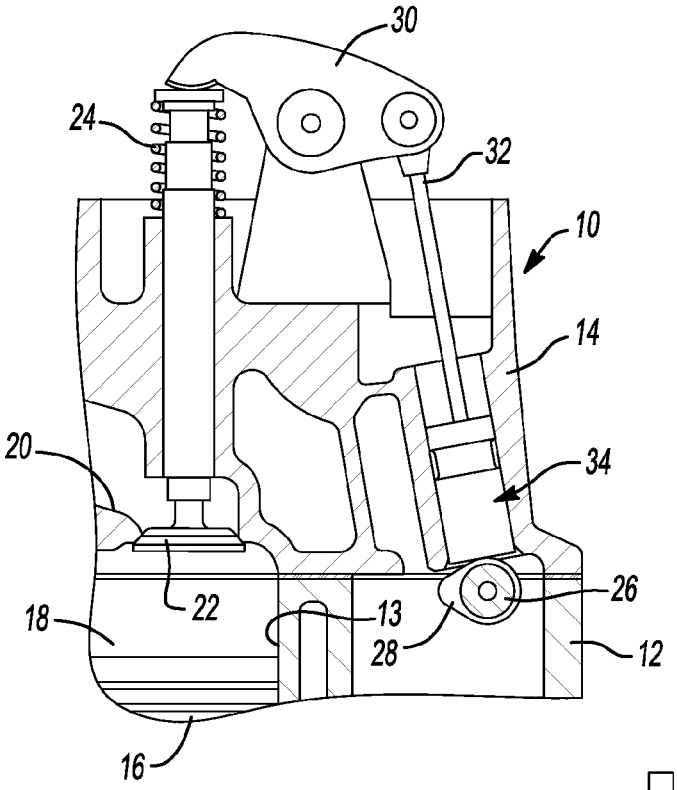

In a traditional valve train system, as a camshaft rotates, it presses against a flat or roller follower surface, which reciprocates to open and close intake and exhaust valves. The interface between the camshaft lobe and the mating follower experiences severe loading whether it is a sliding or rolling type. Although care is taken to well lubricate this interface, instances such as cold start provide opportunities when it is likely that oil will be scarce at times. In such cases, the cam will begin turning before pressure is sufficient to pump oil to the top of the engine. With time these components wear significantly during the life of an engine to require periodic adjustment or the use of self-adjusting hydraulic elements. A basic configuration of a typical valve train is illustrated in FIG. 1.

As fuel economy has become increasingly important, whether overhead valve (OHV) design or overhead cam (OHC) design, engine manufacturers have gone to valve train systems that use rolling contact between camshaft lobes and followers, although some still use sliding follower designs. Conventional camshaft material, such as hardened gray cast iron (GCI), works well under sliding only conditions, and it lacks the necessary material strength under high rolling contact stresses. The same is true for chilled cast iron (CCI) cams. Nodular cast iron (NCI) camshaft material has been used primarily in roller follower type valve trains. In some engine designs, the cam follower interface has also changed from sliding contact type to a roller rocker type, to reduce valve train friction. Thus use of nodular cast iron, as a higher strength substitute for CCI and GCI camshaft material, under sliding contact conditions was never fully explored until this point. No one material for camshafts has been known to meet all the requirements simultaneously under rolling and sliding contact loads, without the use of surface coating or modification on the camshaft or on the mating follower surface.

Cam phasing and variable valve actuation (VVA) are relatively new technologies that attempt to further fine tune fuel economy gains by altering the opening and closing of the valves. Use of rolling only action for both high and low lift conditions for a 2-step VVA mechanism is preferable in an OHC engine as it reduces overall valve train friction. Traditionally, camshafts subjected to predominantly sliding loads, were made from hardened GCI or CCI, and ran against alloyed CCI followers. In a 2-step camshaft design configuration, these cam materials are not expected to sustain the rolling loads, which are typically above 1400 MPa, as it exceeds the materials strength limits. If the design architecture allows use of rolling only interface for variable value actuation configurations then the materials choice is relatively simple. Steel cams under rolling loads work just fine, provided there is ample real estate for the design to work.

However, they exhibit poor response due to adhesive wear under sliding conditions against traditional follower materials.

If design constraints for an overhead cam engine rule out the rolling only option for a 2-step VVA architecture, then a unique valve train design option, consisting of a lobe tri-pack subjected to rolling and sliding loads from the follower elements, is possible. The cam lobe section in contact during the high lift mode is subjected to the sliding loads, whereas during the low lift mode the other lobe section experiences the rolling load.

Assembled camshafts with tailor made lobe materials such as powder metal lobes can be used to handle loading both rolling and sliding, however, it increases the system cost. Valve spring loads, valve lifts, real estate available as well as the performance desired, dictates the use of specific valvetrain architecture employed by any specific engine manufacturer.

Due to lack of data regarding sliding wear resistance of nodular cast iron, diamond-like coating (DLC) on the follower elements subjected to sliding is a safe but expensive choice for switchable roller finger follower (SRFF) mechanisms. Thus, it is desirable to find a materials combination for camshaft lobes and follower elements that will withstand the sliding loads without having to coat the sliding elements of the followers with a diamond-like-coating or having to use powder metal lobes having tailor-made chemistries and microstructures.

SUMMARY

The present disclosure provides an engine valve train including a camshaft having a plurality of camshaft lobes wherein the camshaft lobes are made from a malleable cast iron and are hardened. A plurality of follower pads are made from steel that is carbonitrided and are each in engagement with a respective one of the plurality of camshaft lobes. The material combination provides sliding wear that is comparable to diamond-like coatings while being much less expensive than diamond-like coatings.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
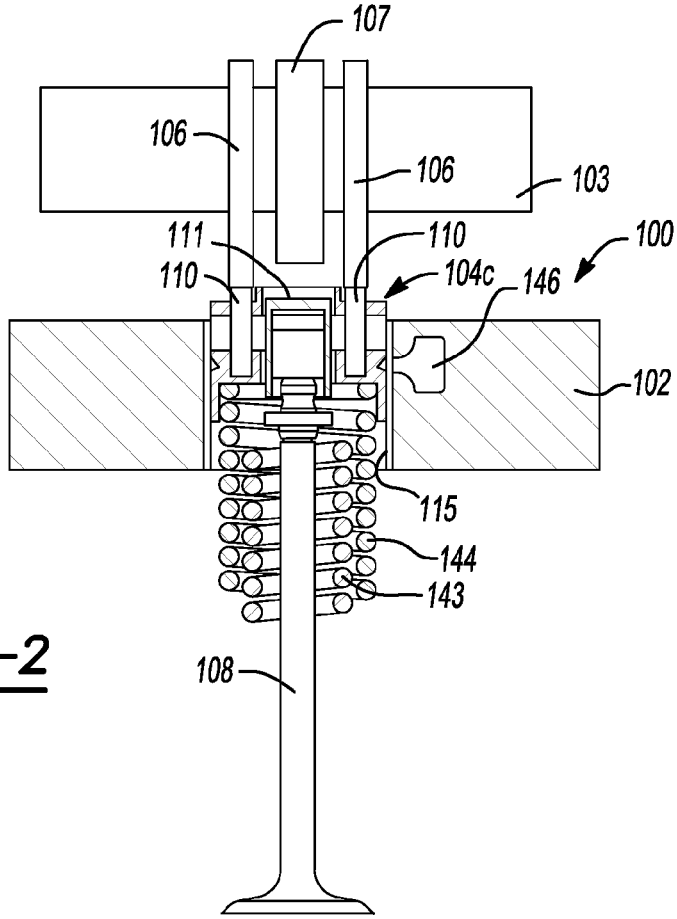

FIG. 1 is a cross-sectional view of an exemplary engine valve train system that can incorporate the material combination of the present disclosure; and FIG. 2 is a cross-sectional view of an exemplary 2-step variable valve actuation system that can incorporate the material combination of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to FIG. 1, numeral 10 generally indicates an internal combustion engine of the four stroke cycle spark ignition type. The engine 10 has major portions of conventional construction including a cylinder block 12 defining a plurality of cylinders 13 and a cylinder head 14 closing the ends of the cylinders. Pistons 16 are disposed in the cylinders 13 and cooperating with the cylinders 13 and the cylinder head 14 to form combustion chambers 18 at the cylinder ends. Intake and exhaust ports are provided for each cylinder, only an intake port 20 being shown. Poppet valves 22 are provided, one in each of the ports and each having a spring 24 biasing its respective valve in a port-closing direction. A camshaft 26 is connected with the engine crankshaft (not shown) for rotation in timed relation with the reciprocating motion of the pistons 16. The camshaft 26 has a plurality of cam lobes 28, one of which is associated with each of the valves 22 for actuating the valve in the proper portion of each engine cycle. The valves and respective cam lobes can include rocker arms 30, push rods 32 and hydraulic tappets 34. These elements are intended to represent conventional constructions which may be found in various forms in automotive vehicle engines. The tappets 34 define follower pads that engage the cam lobes 28.

As an alternative configuration, the valve train could include a two step variable valve actuation system such as disclosed in U.S. Pat. Nos. 5,361,733; 6,848,402; 6,752,107 and 6,923,151 which are herein incorporated by reference in their entirety.

FIG. 2 illustrates an exemplary two step variable lift valve mechanism provided in an overhead cam engine having direct acting cam followers. As shown in FIG. 2, the engine 100 includes a block, head and/or carrier component 102 supporting a camshaft 103 and a plurality of rocker arms 104*c*, only one being shown. The camshaft 103 includes a pair of spaced high lift cams 106 and a central low lift cam 107 for each of the inlet valves 108 and/or exhaust valves of the engine that are actuated by a rocker arm. In the engine shown, each rocker arm 104*c* has a high lift outer cam follower 110 associated with the high lift cams 106 and a low lift inner cam follower 111 associated with the low lift cams. A detailed explanation of the exemplary rocker arms 104*c* is provided in U.S. Pat. No. 5,361,733, which is herein incorporated by reference in its entirety.

It is a discovery of the present disclosure that a materials combination for use in camshaft and cam follower applications which does not require use of coatings either on the camshaft lobes or on the follower pad material. The camshaft or camshaft lobe material is a malleable cast iron. The malleable cast iron can be hardened and tempered. The hardening operation can be done using induction heating, flame heating or using laser power. The hardened matrix microstructure can be tempered martensite and temper carbon. The amount of temper carbon/graphite is less than or equal to 10%. The carbon particle count (particles larger than 25 square microns) is less than 200 per square mm. Lower values of temper carbon particle count, wherein the particle count is between 150 and 200 per square mm have provided best results. The hardness of the camshaft or camshaft lobe materials can be in the range from 50-62 HRC (Rockwell C-scale).

The follower material includes a carbonitrided 52100 steel or carbonitrided 4130 steel. The heat treatment for the follower is carbonitriding as opposed to carburizing or just hardening or tempering. The carbonitriding can be done to a depth of between 0.5 and 1.5 mm and more particularly, about 1 mm and the follower material can have a hardness of 55-64 HRC (Rockwell C-scale). Carbonitriding is a modified form of gas carburizing, in which ammonia is introduced into the gas carburizing atmosphere to add nitrogen to the carburized case as it is being produced. As ammonia dissociates and forms nascent nitrogen at the work surface, nitrogen diffuses into the steel surface simultaneously with carbon. The resultant case which consists of carbides and nitrides is shallower than typically produced by only carburizing, however, provides superior wear response.

The discovery of the present disclosure is that when both malleable cast iron as the camshaft material and carbonitrided 52100 or 4130 steel as mating components is used simultaneously, this materials combination significantly reduces the amount of overall wear. In laboratory tests performed on numerous samples, the use of malleable cast iron for the camshaft lobes according to the above specifications and followers made from cabonitrided 52100 or 4130 steel provided excellent sliding wear resistance equivalent to diamond like coatings.

What is claimed is:

1. An engine valve train, comprising:

a camshaft having a plurality of camshaft lobes, wherein said camshaft lobes are made from a malleable cast iron; and a plurality of follower pads made from carbonitrided steel and each in engagement with a respective one of said plurality of camshaft lobes, wherein said carbonitrided steel is one of 52100 steel and 4130 steel.

2. The engine valve train according to claim 1, wherein said follower pads are carbonitrided to a depth of between 0.5 and 1.5 mm.

3. The engine valve train according to claim 1, wherein said camshaft lobes include a hardened matrix microstructure of tempered martensite and temper carbon/graphite.

4. The engine valve train according to claim 3, wherein said camshaft lobes include an amount of temper carbon/graphite, less than or equal to 10%, and wherein the carbon particle count of particles larger than 25 square microns is less than 200 per square mm.

5. An engine valve train according to claim 4, wherein the carbon particle count of particles larger than 25 square microns is from about 150 to about 200 per square mm.

6. The engine valve train according to claim 1, wherein said camshaft lobes are hardened in from 50 and 62 HRC.

7. The engine valve train according to claim 1, wherein said follower pads have a hardness from 55-64 HRC.

8. An engine valve train, comprising:

a camshaft having a plurality of camshaft lobes, wherein said camshaft lobes are made from a malleable cast iron, wherein said camshaft lobes are hardened from 50 and 62 HRC; and a plurality of follower pads made from carbonitrided steel and each in engagement with a respective one of said plurality of camshaft lobes, wherein said carbonitrided steel is one of 52100 steel and 4130 steel which is carbonitrided to a depth of between 0.5 and 1.5 mm, wherein said follower pads have a hardness from 55-64 HRC.

* * * * *